United States Patent [19]

Langley

[11] 4,100,655

[45] Jul. 18, 1978

[54] BELT BUCKLE

[76] Inventor: Gregory A. Langley, 200 W. 16th St., New York, N.Y. 10011

[21] Appl. No.: 684,590

[22] Filed: May 10, 1976

[51] Int. Cl.[2] ..... F41B 13/04; A45C 11/10; A44B 11/20

[52] U.S. Cl. ..... 24/163 K; 224/2 D; 2/322; 24/77 R

[58] Field of Search ..... 24/163 R, 163 K, 164, 24/77 R; 224/2 D, 26 E, 26 D; 2/322

[56] References Cited

U.S. PATENT DOCUMENTS

| | | | |
|---|---|---|---|
| 135,744 | 2/1873 | Adams | 24/164 |
| 154,673 | 9/1874 | Smith | 24/164 |
| 182,927 | 10/1876 | Smita | 24/164 |
| 1,481,911 | 1/1924 | Kalk | 24/163 R |
| 2,079,981 | 5/1937 | Bednall | 24/77 R |
| 2,433,712 | 12/1947 | Shearon | 24/163 R |
| 2,792,609 | 5/1957 | Pittman | 24/164 |
| 2,965,943 | 12/1960 | Silver | 2/322 |
| 3,272,410 | 9/1966 | Reisman | 24/163 KO |
| 3,295,178 | 1/1967 | Smith | 2/322 |
| 3,823,422 | 7/1974 | Forgeti | 24/77 R |

FOREIGN PATENT DOCUMENTS

| | | | |
|---|---|---|---|
| 278,357 | 10/1951 | Switzerland | 24/77 R |

*Primary Examiner*—Bernard A. Gelak
*Attorney, Agent, or Firm*—Philip Furgang

[57] ABSTRACT

Disclosed is a buckle for a belt in which parts of the buckle are provided in two interrelated, yet separate, parts. The first part, secured to one end of the belt, comprises a plate having two extending tangs. The first tang extends downwardly and through the end of the belt to which it is affixed. It engages an aperture in a rigid loop. The second tang extends upwardly so as to engage the apertures in the free end of the belt, after the belt has been inserted through the rigid loop. The rigid loop has an implement formed as an integral part thereof. The implement is inserted into a pouch in the belt.

5 Claims, 6 Drawing Figures

BELT BUCKLE

BACKGROUND OF THE INVENTION

This invention relates to wearing apparel and, more particularly, to a belt buckle.

Ordinarily, belt buckles comprise two cooperative and interconnected elements — a loop of rigid material secured to one end of the belt, and a tang pivotally secured to and extending into the loop. The loop receives the free end of the belt. The free end is provided with a series of regularly spaced holes so that the belt may be secured to the loop by the tang. Starting with this traditional concept of a buckle, a number of variations have been suggested. Thus, for example, Beaumont, in U.S. Pat. No. 1,345,750, suggests the use of a single plate secured along the side, adjacent to one end of the belt and against the wearer. Secured to the plate and extending transversely through the belt end are two tangs for engaging holes of the other end of the belt. Landgraf et al. in U.S. Pat. No. 1,395,192; Wiethorn in U.S. Pat. No. 2,423,668; Critchley et al. in U.S. Pat. No. 2,548,200; Moss in U.S. Pat. No. 2,898,602; Lostin in U.S. Pat. No. 3,438,063; Collins in U.S. Pat. No. 3,823,421; and Forgett, Jr. In U.S. Pat. No. 3,823,422 all suggest a buckle in which a single element, secured to a free-end engaging element, is used to engage both ends of the belt.

It is considered desirable that the loop for receiving one end of the belt be decorative and, at the same time, have a separate use. In this context, a tang, attached to the rigid loop, for engaging the free end of the belt, serves as an inconvenience. This is particularly true in the devices suggested by Collins and Forgett, Jr., in which the loop for receiving a free end of the belt serves as the handle for a knife or similar implement.

SUMMARY OF THE INVENTION

It is an object of this invention to provide a belt having a rigid, belt-receiving loop wherein the loop has a separate utilization apart from engaging the belt.

It is another object of this invention to provide such a loop and belt wherein the utilization means may be concealed for normal observation.

It is still a further object of this invention to provide means for releasably engaging both the free end of the belt and the rigid belt-receiving loop.

In accordance with the teachings of this invention, there is provided a buckle for a belt which comprises a substantially rigid loop for receiving one end of the belt and means affixed to the other end of the belt for releasably engaging the loop and the one end of the belt.

In one embodiment of this invention, the rigid loop serves as a handle for an implement, such as a knife or the like.

The advantages and features of this invention and its use will be apparent in the course of the following description when taken together with the accompanying drawing.

IN THE DRAWING

DESCRIPTION OF THE PREFERRED EMBODIMENT

Figure 1:
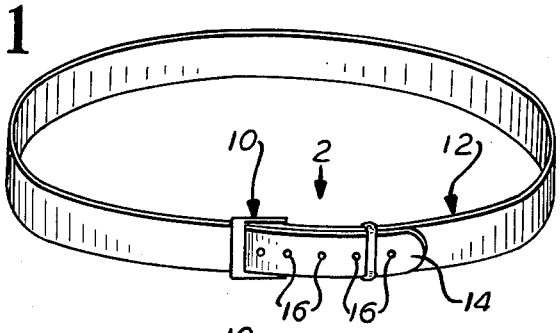
FIG. 1 is a prospective view of a belt and buckle of the invention in its body encircling configuration as it would appear when worn.
Figure 2:
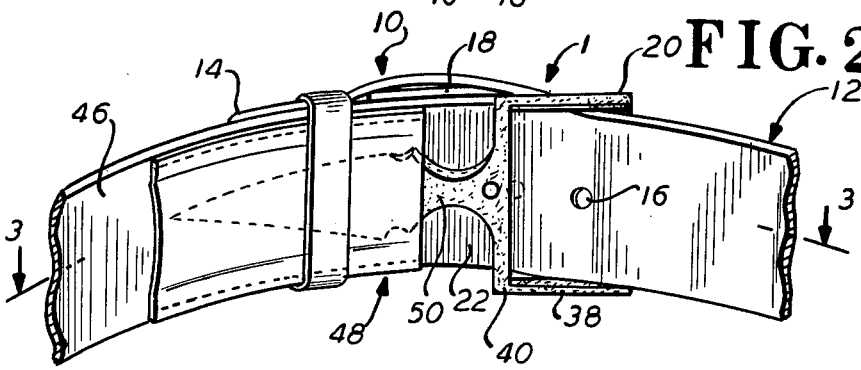
FIG. 2 is an enlarged elevational partial view of the buckle and belt viewed from inside the belt of FIG. 1 in the direction of arrow 2 thereof.
Figure 3:
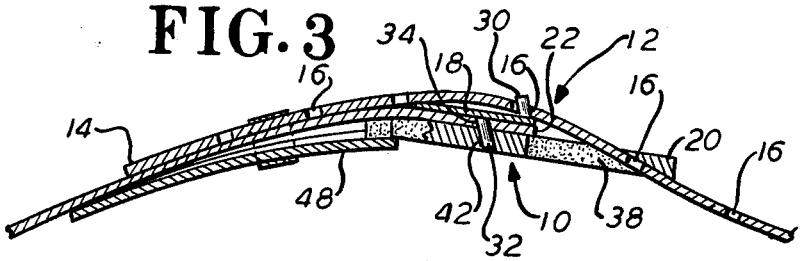
FIG. 3 is a sectional view taken along lines 3—3 of FIG. 2 viewed in the direction of the arrow.
Figure 4:
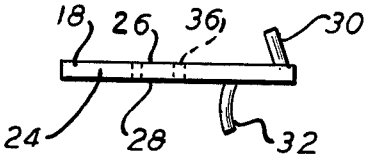
FIG. 4 is a side plan view of an engaging means for engaging the rigid belt-engaging loop and a free end of the belt, constructed in accordance with the teachings of this invention.
Figure 5:
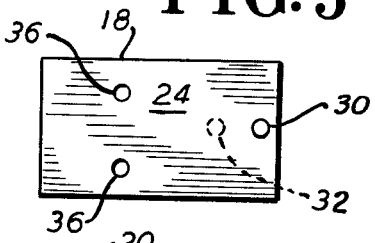
FIG. 5 is a top view of said engaging means.
Figure 6:
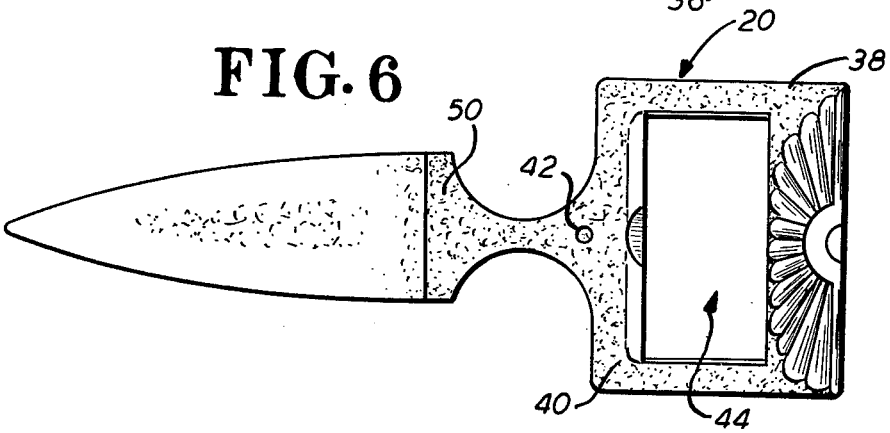
FIG. 6 is a rigid belt-receiving loop, constructed in accordance with the teachings of this invention.

Turning to the drawing (wherein the similar parts are designated by like numerals throughout), for purposes of illustration, there is provided a preferred embodiment of this invention. Thus, there is provided (FIG. 1) a buckle 10 provided in combination with a belt 12. The belt 12 may be of any well known design, such as a band of flexible material made of leather, plastic, or the like. Along one end 14 of the belt 12 may be a series of regularly spaced apertures 16 (FIGS. 1, 2, and 3). The buckle 10 of this invention may generally comprise two sections or parts 18 and 20. One of the important characteristics of this invention is that the parts making up the buckle are separable so that one of the parts can serve an independent function unencumbered by any buckle elements.

The first part 18 is a means affixed to the other end 22 of the belt 12. This first part 18 is intended to be capable of releasably engaging both the second part 20 of the buckle 10 and the first end 14 of the belt 12, the first end 14 being the end having the apertures 16 therein.

The first part 18 preferably takes the form of a thin, but rigid piece 24 of metal such as steel, brass, or the like. This piece 24 may have a generally rectangular shape. Secured to each planar surface 26 and 28 and extending outwardly therefrom may be engaging means such as, for example, tangs 30 and 32. The other end 22 of the belt 12 may have therein an aperture 34, so spaced as to receive the lower tang 32 therethrough. The rectangular part 24 may be secured to the end 22 of the belt 12 as, for example, by rivets (not shown) inserted through suitable holes 36 in the plate 24 and belt. This lower tang 32, which extends downwardly through the aperture 34 in the end 22 of the belt 12, is intended to engage the second part 20 of the buckle 10. This will be more apparent from the following discussion.

The lower tang 32, in combination with the rivets (not shown), serves to hold the secured plate 24 securely in place upon the upper surface 38 (i.e., the surface of the belt 12 opposed to the wearer) at the other end 22 of the belt 12. The second part 20 of the buckle 10 may comprise a rigid loop 38, of conventional design, for receiving the first end 14 of the belt 12. Along one side 40 of the loop 38, as for example, symmetrically and centrally disposed across the width thereof, may be an aperture 42. This last-mentioned aperture 42 is intended to receive the lower tang 32 which extends downwardly through the aperture 34 in the other end 22 of the belt 12. When the first end 14, having the apertures 16 therein of the belt 12, is passed through the opening 44 of the loop 34, it passes, in a conventional manner, over the other end 22 of the belt 12 and is engaged by the upper tang 30.

The belt 12 may be provided with a strip 46 of flexible material, similar to the belt material, and affixed to an inner surface 46 at the other end 22 of the belt 12 (having the first part 18 secured thereto) so as to form a pouch 48 (FIG. 3). The purpose of the pouch 48 is to receive one end or stem 50 of the rigid loop 38. This, in combination with the pouch 48 and the lower tang 32, holds the rigid loop 38 securely, but releasably, in place. A flexible loop 52 may surround the belt 12 and be used to hold the first end 14 against the belt 12. The upper and lower tangs 30 and 32 of the engaging means 18 are preferably canted towards the ends 14 and 22 they are intended to engage. Thus, the upper tang 30, when engaging one of the apertures 16 of the first end 14 of the belt 12, is canted toward that end 14 (FIG. 1). In a like manner, the lower tang 32 is canted toward the end of the rigid loop 38.

In one preferred embodiment, the stem 50 of the rigid loop 34 takes the form of a knife or similar implement.

In use, when the wearer wishes to use the loop 38 as an implement apart from the buckle 10, the wearer merely removes the first end 14 of the belt 12 from the upper tang 30 and draws it out of the rigid loop 34. At the same time, the lower tang 32, to which the first element 18 is secured, is lifted out of the aperture 42 of the rigid loop 38, thereby releasing the implement. It should be noted that the lack of a tang-like projection, common to the prior art buckles, leaves the implement 52 free of impediments that would make the holding of it difficult or uncomfortable for the user. In the preferred embodiment, the implement 52, at the end of the rigid loop 38, takes the form of a knife 52. However, other devices may be provided in place thereof. Thus, for example, the extending implement may take the form of a can opener. In the alternative, it may serve as the means for holding or securing such items as house keys or the like. More importantly, the lack of the need for specialized projections and the simplicity with which an aperture may be formed in a buckle means that a variety of decorative buckles may be formed. Thus, a wearer may replace one decorative buckle with another, depending on the type of wear the user wishes to provide. It is clear that formal attire might suggest one type of rigid loop, whereas another type of dress would suggest still another style. It is also clear that the means for engaging need not be the simple metal piece with extending upper and lower tangs, such as declared herein. Thus, the engaging means might be a snap, clip, or other similar means. Furthermore, it is clear that it is not necessary that that which is secured to one end of a belt and releasably engages the rigid loop and the other belt end be formed on a single rigid plate, as shown herein. Thus, tangs or other engaging means might be separately secured to the belt.

What is claimed is:

1. A buckle for a belt of the type having a plurality of regularly spaced holes along a first end and the buckle engaged with the second end, or similar wearing apparel, comprising:

(a) a substantially rigid buckle member having a loop for receiving therethrough the first of two ends of the belt; and (b) interlocking means permanently affixed to the second end of the belt releasably interlocking with the first end of the belt, after the first end has been passed through said loop, and releasably interlocking with said buckle member.

2. A buckle, as recited in claim 1, wherein said interlocking means comprises extending members, the first of said members for releasably interlocking the first end of the belt and the second of said members for releasably interlocking with said buckle member.

3. A buckle, as recited in claim 2, wherein said interlocking means comprises a rigid plate member, said first and second members comprise tangs rigidly affixed to said plate and extending from either opposed planar surfaces, said buckle member having therein an aperture for releasably receiving said second tang.

4. A buckle, as recited in claim 3, wherein said rigid buckle member comprises an integral stem extending therefrom for interlocking with a predetermined part of the second end of the belt, such that, in combination with said first tang, said loop is releasably held in a fixed position with respect to the second end of the belt.

5. A buckle, as recited in claim 4, wherein said buckle member aperture, being symmetrically disposed with respect to the width of the belt, said stem comprising a knife blade, the belt having a pouch attached to the inner surface adjacent to the second end of the belt to receive said knife, said second tang for interlocking with a selected one of the apertures in the first end of the belt.

* * * * *